US011346261B2

(12) United States Patent
Bedi et al.

(10) Patent No.: US 11,346,261 B2
(45) Date of Patent: May 31, 2022

(54) SYSTEM AND APPARATUS FOR PROCESSING FLUIDS PRESENT IN DEVICES HAVING HYDRAULIC SYSTEMS

(71) Applicant: K.J. Manufacturing Co., Wixom, MI (US)

(72) Inventors: Vivek Bedi, Wixom, MI (US); George Blundy, Walled Lake, MI (US)

(73) Assignee: K.J. Manufacturing Co., Wixom, MI (US)

( * ) Notice: Subject to any disclaimer, the term of this patent is extended or adjusted under 35 U.S.C. 154(b) by 616 days.

(21) Appl. No.: 16/000,584

(22) Filed: Jun. 5, 2018

(65) Prior Publication Data

US 2018/0347420 A1 Dec. 6, 2018

Related U.S. Application Data

(60) Provisional application No. 62/515,433, filed on Jun. 5, 2017.

(51) Int. Cl.

| | |
|---|---|
| ***F01M 11/04*** | (2006.01) |
| ***F01M 11/00*** | (2006.01) |
| ***F01M 11/10*** | (2006.01) |

(52) U.S. Cl.

CPC ..... *F01M 11/0458* (2013.01); *F01M 11/0004* (2013.01); *F01M 11/045* (2013.01); *F01M 11/10* (2013.01); *F01M 2011/007* (2013.01); *F01M 2011/0029* (2013.01)

(58) Field of Classification Search

CPC ..... F01M 11/0458; F01M 11/0004; F01M 11/045; F01M 11/10; F01M 2011/027; F01M 2011/007; F15B 21/005; F16N 39/06

See application file for complete search history.

(56) References Cited

U.S. PATENT DOCUMENTS

| | | | | |
|---|---|---|---|---|
| 2,435,832 A * | 2/1948 | Harvuot | ..... | F16N 39/06 184/55.1 |
| 3,385,735 A * | 5/1968 | Brabrand | ..... | B08B 3/00 134/28 |
| 3,954,611 A | 5/1976 | Reedy | | |

(Continued)

FOREIGN PATENT DOCUMENTS

| | | |
|---|---|---|
| KR | 101312600 B1 | 9/2013 |
| RU | 46746 U1 | 7/2005 |
| RU | 2486353 C1 | 6/2013 |

OTHER PUBLICATIONS

International Preliminary Report on Patentability and Written Opinion of the International Searching Authority for PCT/US2018/036147; International Bureau; dated Dec. 17, 2020; 5 pages.

(Continued)

*Primary Examiner* — Michael A Riegelman

(74) *Attorney, Agent, or Firm* — Young Basile Hanlon & MacFarlane, P.C.

(57) ABSTRACT

A device for reciprocatingly removing and replenishing fluid in circulating system of an hydraulic mechanism that includes at least two processing tanks, at least one air pressure regulator and connector releasably engageable with a pressurized air source, at least one vacuum generator, at least one pressure regulator; and means for removing the fluid from the circulating system at vacuum.

17 Claims, 6 Drawing Sheets

(56) References Cited

U.S. PATENT DOCUMENTS 4,128,140 A * 12/1978 Riches ..... F01M 11/0458 184/1.5
4,378,026 A * 3/1983 Bauer ..... F01M 11/045 137/205
5,121,599 A * 6/1992 Snyder ..... F01D 25/20 184/6.11
5,154,775 A * 10/1992 Bedi ..... F01M 11/0458 123/196 R
5,390,636 A 2/1995 Baylor et al.
5,554,278 A * 9/1996 Henderson ..... F01M 11/04 123/575
5,685,396 A 11/1997 Elkin et al.
5,853,068 A * 12/1998 Dixon ..... F01M 11/045 184/1.5
5,860,459 A 1/1999 Reed et al.
5,964,318 A 10/1999 Boyle et al.
6,071,355 A 6/2000 Suratt
6,073,666 A 6/2000 Clark, II
2003/0015463 A1* 1/2003 Viken ..... F01M 11/0458 210/138
2004/0045609 A1* 3/2004 Apostolides ..... F01M 11/0408 137/560
2004/0211470 A1* 10/2004 Apostolides ..... F15B 21/005 137/565.11

OTHER PUBLICATIONS

International Search Report and Written Opinion for PCT/US2018/036147, dated Feb. 21, 2019, 6 pages.
European Search Report for European Patent Application No. 18921660.9, dated Dec. 13, 2021, 10 pages.

* cited by examiner

SYSTEM AND APPARATUS FOR PROCESSING FLUIDS PRESENT IN DEVICES HAVING HYDRAULIC SYSTEMS

The present application is a non-provisional utility application claiming priority to U.S. Provisional Application Ser. No. 62/515,433 filed Jun. 5, 2017, the specification of which is incorporated by references in its entirety.

BACKGROUND

This disclosure relates to methods and devices for processing oil-based materials and other fluids present in and employed by the automotive vehicle.

Lubrication is necessary for efficient operation of various engines and motor devices as well as ancillary devices associated with automotive vehicles. In various devices, such as internal combustion engines, lubrication oil is recirculated through lubrication passages defined in the engine during routine engine operation. An associated reservoir such as an oil pan contains the lubrication oil between periods of engine operation and holds excess or reserve oil during periods of engine operation.

In order to maintain the engine and ensure proper engine life, it is necessary to remove spent engine oil and replace it with fresh or reconditioned material. It is desirable that these oil change operations be accomplished in an efficient, environmentally friendly manner. In many situations, this includes the use of automated oil change devices.

Heretofore it has been believed that the effectiveness a fluid change operation such as manual or automated fluid removal operations is dependent on the completeness of the evacuation of the associated on-board reservoir of the oil pan. In fluid change systems known heretofore, it is believed that solid waste, residue and degraded oil products that collected in the bottom of the associated reservoir, if allowed to remain during evacuation, would mix with the newly added material and could reduce the life and effectiveness of any newly added material. In certain instances, it was believed that the solid waste, residue and degraded oil could accumulate in the oil pan over time creating an undesirable sludge that is difficult to remove. To avoid such problems, it was believed that complete evacuation of the fluid system to be required or desired. While this can be desirable, it can be appreciated that complete evacuation procedures can be time consuming and complicated. And in certain situations, complete evacuation of a fluid system can increase the risk of mechanical issues that may be precipitated or exacerbated by fluid removal as may occur due to inadequate fluid refilling operations. Thus, it would be desirable to provide an effective fluid treatment and conditioning process that could accomplish effective fluid treatment and processing as desired or required.

SUMMARY

A device and method for reciprocatingly removing and replenishing fluid in circulating system of a hydraulic system that includes at least two processing tanks, at least one air pressure regulator and connector releasably engageable with a pressurized air source, at least one vacuum generator, at least one pressure regulator; and means for removing the fluid from the circulating system at vacuum.

The method as disclosed herein includes the steps of establishing pneumatic and fluid connection with at least one location in the hydraulic fluid circulating system that draws from the lowermost region of the fluid reservoir; establishing fluid connection with at least one point in fluid circulating system proximate to the upper region of the fluid reservoir; after pneumatic and fluid connection is established, drawing a vacuum pressure through said pneumatic connection and removing a t least a portion of the hydraulic fluid to an external filtration device and reintroducing the volume of removed fluid from the external filtration device into the circulating system through said fluid connection.

These and other aspects of the present disclosure are disclosed in the following detailed description of the embodiments, the appended claims and the accompanying figures.

BRIEF DESCRIPTION OF THE DRAWINGS

The invention is best understood from the following detailed description when read in conjunction with the accompanying drawings. It is emphasized that, according to common practice, the various features of the drawings are not to-scale. On the contrary, the dimensions of the various features are arbitrarily expanded or reduced for clarity.

DETAILED DESCRIPTION

The present disclosure is directed to a process and/or device for filtering and/or conditioning one or more of the various fluids associated with an internal combustion engine system or ancillary systems, herein defined as a "target fluid". The present disclosure can be employed to recondition various fluids associated with internal combustion engines, and associated automotive vehicles or stationary power plants including but not limited to, organic oil compositions used as lubricants, power transfer fluids, hydraulic fluids, etc.

Fluid conditioning as defined in this disclosure encompasses a process whereby incremented amounts of at least one target fluid are drawn out of the target circulating system in an associated internal combustion engine or associated therewith. The incremented amount(s) of the at least one withdrawn target fluid material are cycled through the device as disclosed herein and are reintroduced into the target circulating system in the associated internal combustion engine or other suitable device.

In the process as disclosed herein, the target circulating system of the associated internal combustion engine can include an on-board reservoir. The on-board reservoir can be in fluid communication with the fluid circulating system associated with the internal combustion engine. In certain embodiments, the withdrawal of target fluid in incremented amounts can be accomplished in in a continuous process. In certain embodiments, the withdrawal of target fluid can be accomplished in at least two discrete portions if desired or required.

Figure 1:
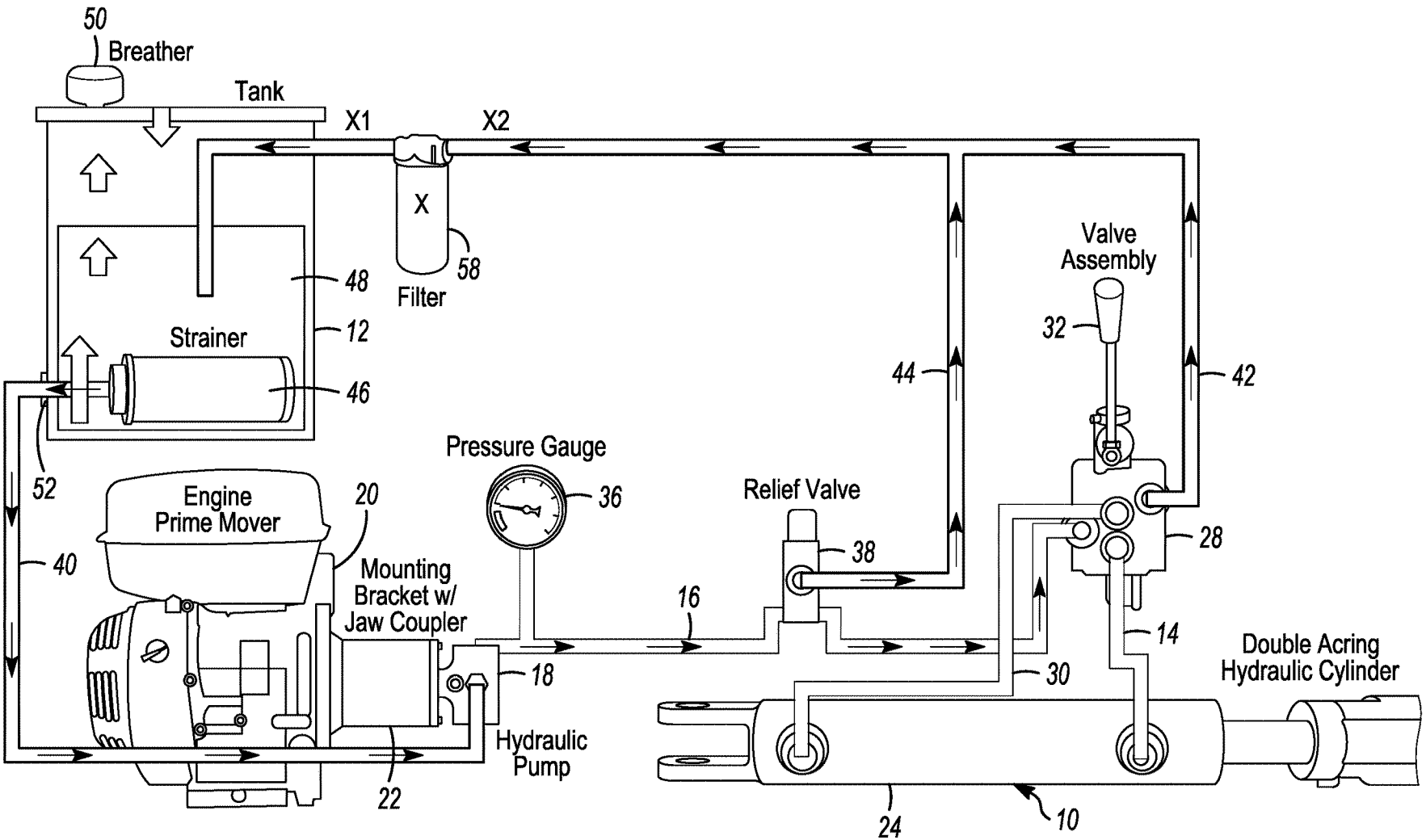
FIG. 1 is schematic view of a representative embodiment a system with a circulating fluid as disclosed herein in which the process and device disclosed herein can be employed.

In certain embodiments, at least a portion of the target fluid can be removed as required. It is contemplated that the method and device as disclosed herein can be employed with various fluid systems that are associated with stationery and mobile engines and systems associated therewith. In certain applications, the associated circulating system can be a hydraulic system 10, an example of which is depicted in FIG. 1. It is contemplated that the hydraulic system that can be self-contained in certain embodiments. It is also within the purview of this disclosure that the associated hydraulic system such as a hydraulic cylinder can be in fluid communication with at least one on-board reservoir (not shown).

In the hydraulic system 10 as depicted, the on-board reservoir 12 is in fluid communication with the operating circuit 14 defined in the hydraulic system 10 via a conduit 16 that communicates with a hydraulic pump 18 operatively connected to a prime mover such as an internal combustion engine 20 and associated power take off unit 22. Hydraulic pump 18 is configured and positions to maintain hydraulic pressure in the associated system. Hydraulic pump 18 can configured to draw suitable make up hydraulic fluid from any on-board reservoir and into ultimate communication with at least one hydraulic cylinder such as hydraulic cylinder 24. The hydraulic cylinder can have any suitable configuration. One non-limiting example of a suitable hydraulic cylinder is a double-acting hydraulic cylinder such as that depicted in FIG. 1.

In the embodiment depicted, the hydraulic system 10 includes at least one conduit 16 that is configured to convey hydraulic fluid from the hydraulic pump 18 into a suitable port defined in the hydraulic cylinder 24. In the embodiment depicted in FIG. 1, a valve assembly mechanism 28 is in fluid contact with conduit 26 and is configured to provide communication between the hydraulic cylinder 24 and any the on-board reservoir when required and to provide a closed circuit within the hydraulic cylinder 24 in operative communication with conduits 30 and 32 during operation of the hydraulic cylinder 24. Where desired or required, the valve mechanism 28 can be configured as a three-way valve mechanism that permits fluid communication between conduit 26 and hydraulic cylinder 24, between a first end and a second end of the hydraulic cylinder 24, and between the interior of the hydraulic cylinder 24 and the on-board reservoir 12 in a manner that will be describe subsequently.

In certain embodiments, the valve assembly mechanism 28 can be configured to provide complete isolation of the circuit formed between conduits 14 and 30, hydraulic cylinder 24 and valve assembly mechanism 28 as when a three-way valve present in the valve mechanism 28 is in a first position. Make-up hydraulic fluid can be added as desired or required by actuation of the valve assembly mechanism 28 as when the three-way valve is brought into a second position. Such actuation can be controlled by suitable sensor inputs generated by sensors (not shown) that are associated with the hydraulic cylinder 24. It is also contemplated that the valve assembly mechanism 28 can be configured to move into a position that permits fluid to be removed from the hydraulic system and/or make-up fluid to be introduced into the hydraulic cylinder 10. Actuation of valve assembly mechanism 28 can be accomplished by various suitable devices. Non-limiting examples of such actuation devices include various electronic switches. In the embodiment as depicted in FIG. 1, manual actuation of the valve assembly 28 can be accomplished by lever member 32.

The conduit 16 can include suitable pressure and flow regulators as desired or required, at least one gauge such as suitable pressure gauge 36 such and/or at least one pressure regulator such as relief valve 38. The at least one pressure gauge 36 and at least one pressure relief valve 38 can be included at any suitable location on the conduit 16 if desired or required. These devices can function to regulate and monitor the fluid pressure associated with hydraulic cylinder 24 and the associated fluid circuit. In various embodiments, at least one of the pressure gauge 36 and/or pressure relief valve 38 are located upstream of the hydraulic cylinder 24. In the embodiment depicted in FIG. 1, one or both of the pressure gage 36 and the pressure relief valve 38 are positioned in the conduit 16 upstream of the hydraulic cylinder 24.

The hydraulic system 10 as depicted in FIG. 1 also includes an on-board reservoir 12 in fluid communication with the hydraulic cylinder 24 via a conduit such as fluid conduit 40. Fluid conduit 40 can be connected in the system in any manner that permits passage of fluid from the reservoir 12 to the hydraulic pump 18.

The hydraulic system 10 can also include a fluid return conduit 40 located in fluid communication between and with the hydraulic cylinder 24 and the on-board reservoir 12 in a manner that permits return passage of hydraulic fluid from the interior of the hydraulic cylinder 24 to the on-board reservoir 12 when the valve assembly mechanism 28 is in a third operative position. Where desired or required the valve present in the valve assembly 28 can be configured such that the third position facilitates circulation of fluid from the on-board reservoir 12, through conduit 26 and the interior of hydraulic cylinder 24 and back to the on-board reservoir via conduit 40.

Where desired or required, the hydraulic system 10 can also include a pressure relief conduit 44 that communicates between pressure relief valve 38 and fluid return conduit 42 to regulate over pressure.

Where desired or required, the on-board reservoir 12 can be configured with at least one straining device 46 that located in the interior of the onboard reservoir 12 that is in fluid communication with the conduit 16 such that fluid drawn from the onboard reservoir 12 passes through straining device 46 to remove at least a portion of any particulate material repent in the fluid prior to transit through the conduit 40. Such particulate matter can develop during use of the hydraulic cylinder 24 and can accumulate in the lower regions of the on-board reservoir 12.

The on-board reservoir 12 can be a closed vessel defining an interior chamber 48 having a volume greater than the volume of the circulating fluid and can be equipped suitable at least one suitable pressure regulating vent such as breather 50. Where desired or required, the on-board reservoir 12 can also include at least fluid coupling member 52 that is located at a location providing fluid access to the lower most region of the interior chamber and provide access to the fluid contained therein. In certain embodiments, the fluid coupling member 52 can be a quick connect coupling.

During routine operation of the hydraulic cylinder 12, the hydraulic fluid contained therein is subjected to repeated stress. Recirculation of the hydraulic fluid permits through the circuit permits the removal of contaminants such as particulates and the like by devices such as the internal strainer 46 present in the on-board reservoir 12. Continued recirculation of the fluid results in elevated levels of contaminant build up in the hydraulic fluid present in the on-board reservoir 12. Thus, in certain embodiments, the fluid recirculating system can include in-circuit filtration unit(s) such as filter 52. In embodiments, such as that depicted in FIG. 1, the filter 52 can function during normal system operation and can be configured to be removed and replaced periodically. It is also contemplated that contaminant concentration in the fluid can be lowered by dilution as by addition of make-up quantities of fluid such as hydraulic fluid, the total contaminant concentration level in the on-board reservoir 12. Either approach is limited and the contaminant load present in the circulating fluid may be not readily reduced. Ultimately the increasing levels of contamination can impair the function of the of the system and one or more of the associated parts such as hydraulic cylinder 24. Because of this, such systems are typically evacuated, and the fluid contained therein is discarded at great cost and risk to the environment.

The process and device as disclosed herein can be employed to process and condition circulating fluid resident in at least one fluid reservoir or holding tank associated with an engine. Non-limiting examples of such systems include hydraulic fluid systems, lubricating fluid systems, coolant fluid systems and the like. Associated systems may include at least one fluid circulating system as well as at least one actuator. Systems such hydraulic fluid systems also include at least one generator such as a hydraulic pump that can be driven by a suitable mechanism such as an electric motor, a combustion engine and the like, as well as suitable valves piping etc. In certain embodiments, the actuator can be composed of one or more hydraulic cylinders. Where desired or required, the hydraulic system can include one or more reservoirs comprising a hydraulic circuit. It is to be understood that the method and device as disclosed can also be used with systems employing or including suitable hydraulic motors as desired or required.

In fluid hydraulic systems, it is contemplated that the system will also have hydraulic fluid circulating in a hydraulic circuit having the at least one hydraulic cylinder, at least one on-board hydraulic fluid reservoir and at least one hydraulic fluid conduit. As broadly disclosed, the process disclosed herein achieves reduction of contaminant levels present in the fluid present that is present in the on-board reservoir. Once the fluid present in the on-board reservoir has been processed, the fluid that is circulating in the system including the fluid in the on-board reservoir may also be processed to achieve at least one of the following: reduction in contaminant levels in the fluid, reduction in the wear associated with functioning of the associated hydraulic device, increased in hydraulic system life, maintenance of optimum hydraulic system function.

Figure 2:
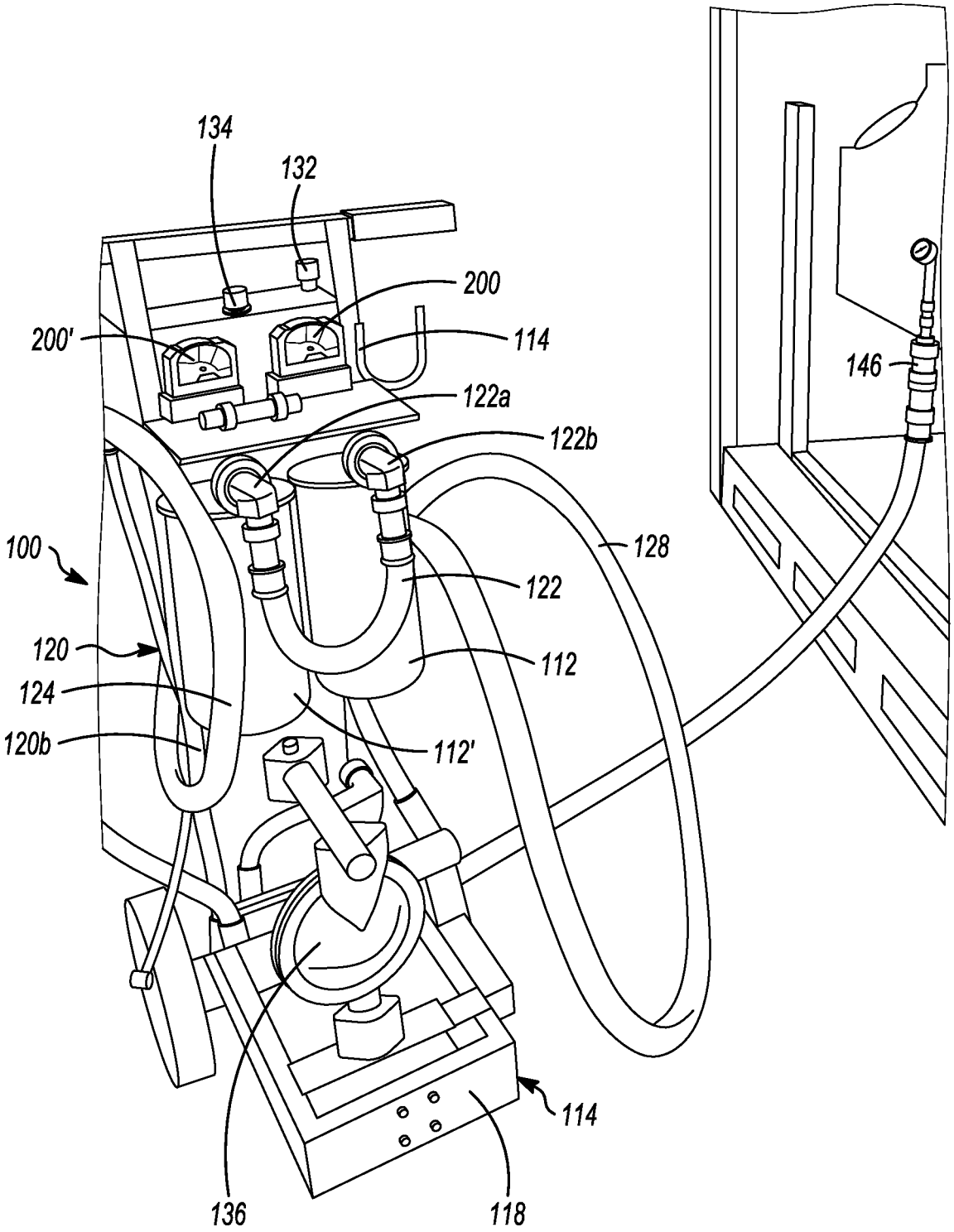
FIG. 2 is side view of an embodiment of the device as disclosed herein.
Figure 3:
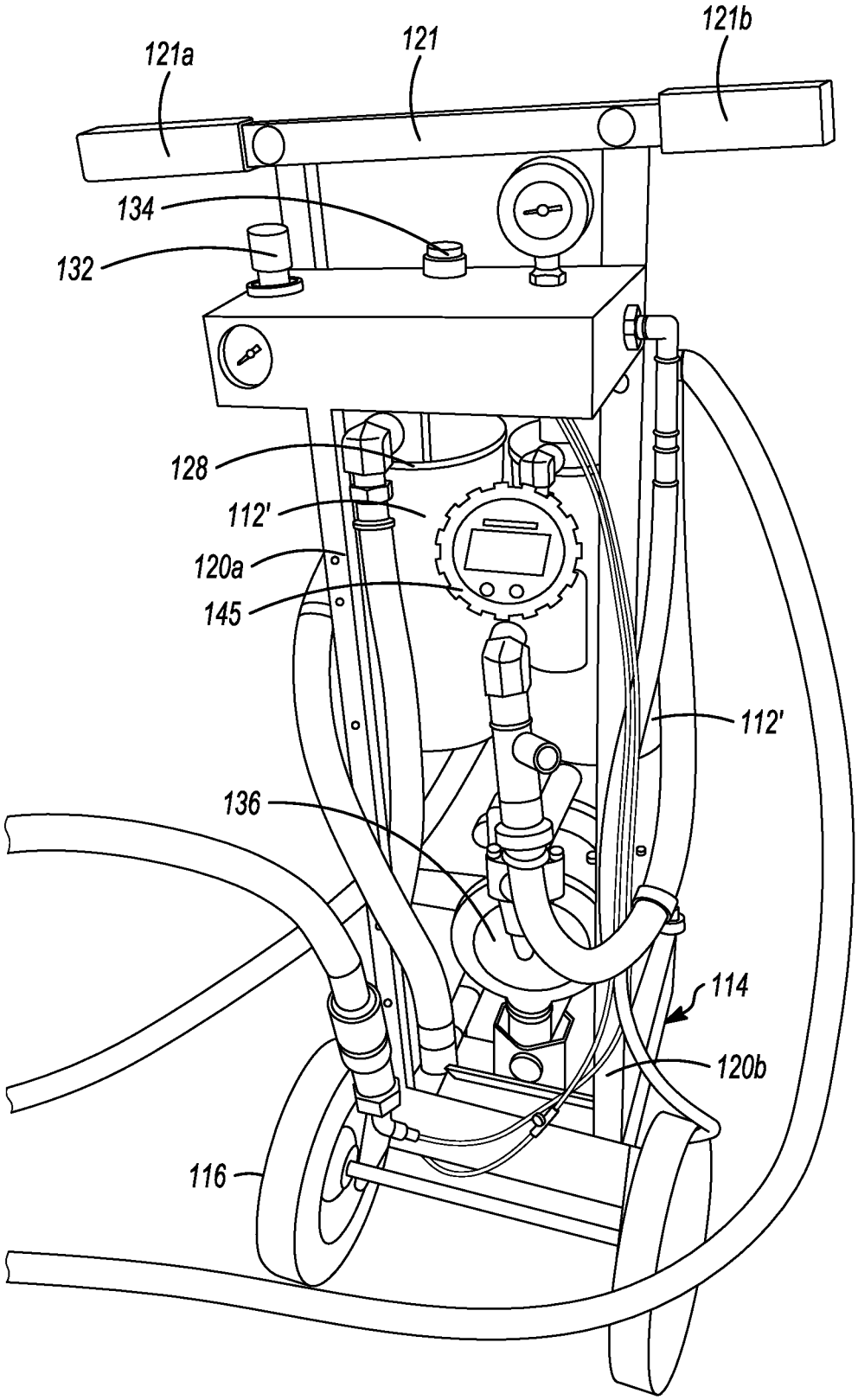
FIG. 3 is an alternate side view of the device as disclosed in FIG. 2.

The fluid exchange device 100 as disclosed herein and depicted in FIGS. 2 and 3 includes at least one processing tank 112 that is mounted on a suitable frame 114. In the embodiment depicted in the drawing figures, the fluid exchange device includes at least two processing tanks 112, 112'. The at least two processing tanks 112, 112' can be set up in series to one another or in parallel, depending upon specific processing requirements.

In the embodiment as illustrated, frame 114 can be moveable and can configured with suitable wheels 116 rotatable mounted to the base 114 as desired or required. In certain embodiments, the frame 114 can have a base member 118 and an upright member 120 extending perpendicularly upward therefrom with the wheels 116 mounted adjacent to the junction between the base 118 and the upright member 120. It is also contemplated that the frame can include two pairs of wheels 116 (not shown) that extend from a lower face of the base member 118 to contact a suitable support surface. Where desired or required, the frame can be composed of suitable metal elongate members fastened to one another by any suitable mechanism such as welding, bolting or the like.

In the embodiment depicted, the base member 118 can have a suitable rectangular or square configuration. The base member lib can be configured as an open frame in certain embodiments. The upright member 120 can be composed of pair of arms 120*a* and 120*b* that can be affixed to the frame in any suitable manner such as welding bolting or the like. In certain embodiments, the arms 120*a* and 120*b* can be elongate members that are disposed in spaced parallel relationship to one another and are connected to one another at an upper region by a handle member 121. Handle member 121 can include hand grip regions 121*a* and 121*b* as desired or required. In the embodiment depicted, hand grip regions 121*a* and 121*b* project outward contiguously form the handle member 121 at an orientation perpendicular to the upright member 120 to a distal location that is beyond the space defined by the base member 118.

Where two or more treatment tanks such as treatment tanks 112, 112' are employed, it is contemplated that the tanks 112, 112' can be connected in series or parallel and can each contain one or more filtration and/or purification media as desired or required. In certain embodiments, the at least two tanks 112, 112' will be connected in series such that the latter tank(s) will receive partially purified fluid from prior upstream tank(s) and will contain filtration and/or purification media configured to further purify and filter the fluid received. The tanks 112, 112' can be configured to withstand periodic pressurization and/or depressurization.

When tanks 112, 112' are connected in series, the device 100 can also include at least one conduit 122 connected between the at least one upstream tank 112 and the at least one downstream tank 112' to facilitate fluid communication therebetween. Suitable check valve(s) can be positioned in the inter-tank conduit 122 and/or at the junction of the respective tank 112, 112' with the inter-tank conduit 122 as desired or required to facilitate directional fluid flow. Junction check valves are designated by reference numeral 122*a* and 122*b*. In the embodiment depicted in FIG. 2, the inter-tank conduit 122 is connected to the respective tanks 112, 112' at a location proximate to the upper position of the respective tanks when the device 100 is in the operative or use position.

The device 100 can include suitable means for detachably or releasably connecting the tank(s) 112, 112' to the associated fluid system of an associated engine or hydraulic system. In the embodiment depicted in FIGS. 2 and 3, the fluid connection means include at least one suction hose 124 and at least one discharge hose 126. The suction hose 124 and discharge hose 126 are coupled to the tanks 112, 112' at any suitable location. In the embodiment depicted, the suction hose 124 is coupled to initial tank 112 at a location proximate to its upper end 128 of tank 112 when the device 100 is in the operative or use position and provides fluid communication with the interior of the associated tank 112.

The suction hose 124 connection can be located in the general upper region 188 of initial tank 112 such that the fluid to be conditioned that is drawn out of the associated engine system can be introduced into the upper region of the tank 112. The tank 112 can include suitable flow directing elements (nor shown) located in the interior chamber defined in the tank 112 such that the introduced fluid to be conditioned traverses the interior of the associated tank 112 and exits the associated tank 112 at an upper location 132. The fluid material to be conditioned can be introduced into a subsequent or downstream fluid tank 112' in a similar manner. Thus, the subsequent or downstream tank 112' can include suitable flow directing elements (nor shown) located in the interior chamber defined in the tank 112' such that the introduced fluid to be conditioned traverses the interior of the associated tank 112' and exits the associated tank 112' at an upper location 132.

The tank(s) 112, 112' will have sufficient interior volume(s) to receive and treat the transferred fluid. Tank(s) 112, 112' can be configured with suitable devices to ensure that air is not introduced into the circulating system. This can include suitable floats or shut off valves positioned in the tank to prevent over-evacuation of the respective tank 112, 112' during fluid fill operations or overfilling during fluid removal operations.

Figure 4:
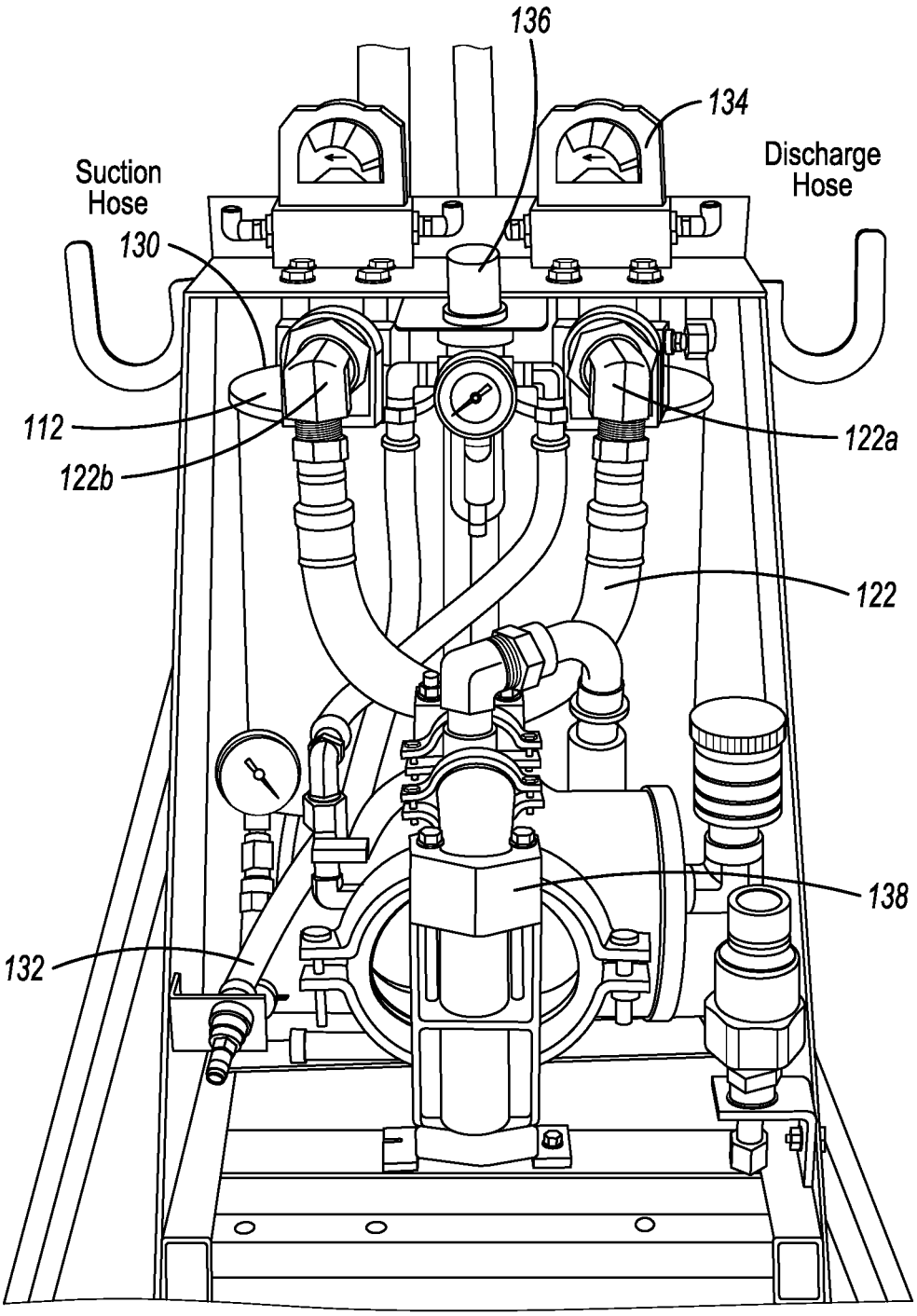
FIG. 4 is a front view of the device of FIG. 2 with suction and discharge hoses removed.
Figure 5:
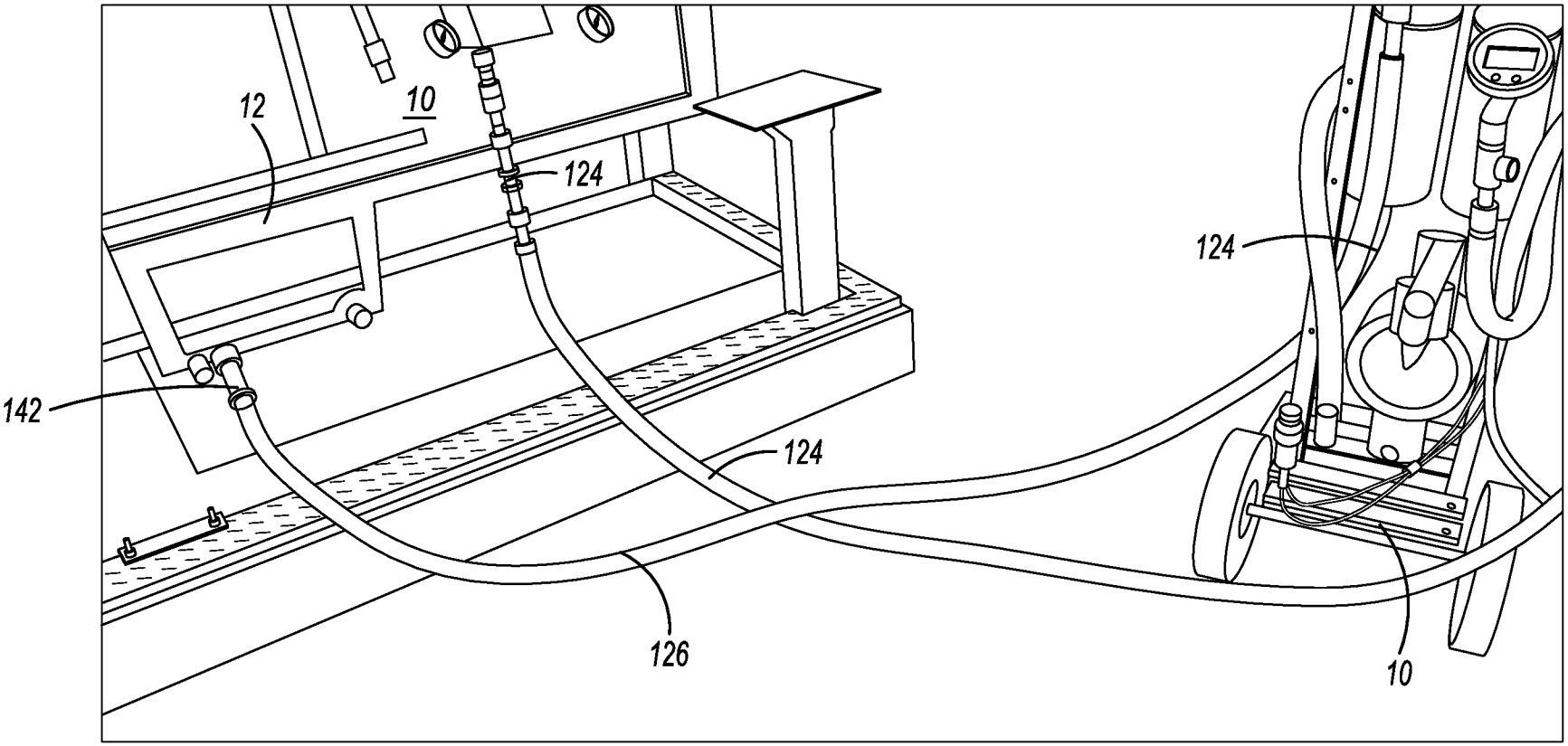
FIG. 5 is a perspective view of the device of FIG. 1 in operative connection to a representative hydraulic system.

The device 100 can also include a suitable control mechanism(s) that can regulate and direct the application of suction and discharge. The device 100 can include suitable user-operated switches or can be automated as desired or required. In the embodiment depicted in FIGS. 2, 3 and 4, it is contemplated that the device will be user operated by suitable manual switches such as switches 132 and 134.

The device 100 can have at least one mechanism for providing suction to the suction hose 124. Where desire or required, the device 100 can include suitable compressors such as compressor pump if desired or required. The device 100 as depicted in the various drawing figures will include suitable coupling mechanisms to establish communication with a suitable pressurized air supply such as a shop air or the like. In the drawing figures, the device 100 includes at least one pneumatic connector that is releasably connected to a suitable pneumatic hose (not shown) that is connectable to the pressurized air source and can operate a vacuum pump such as vacuum pump 136.

The device 100 also includes a connection device that can be mounted to the fluid circulating device 10 at a suitable location to facilitate releasable connection between the suction hose 124 and the fluid circulating system of the mechanism to be serviced. In certain embodiments, this connection device 140 can be a suitable quick connect adapter that can releasably and matingly connect to the device 10 to be serviced to establish fluid communication therebetween.

Where the configuration of the device 10 to be serviced is configured as in FIG. 1, cleaned conditioned fluid can be introduced back into the associated system 10 for device to be serviced from the final tank 112' via discharge hose 126 at a position upstream of onboard reservoir 12 such that the conditioned fluid is introduced onto the top surface of fluid in the reservoir.

Figure 6:
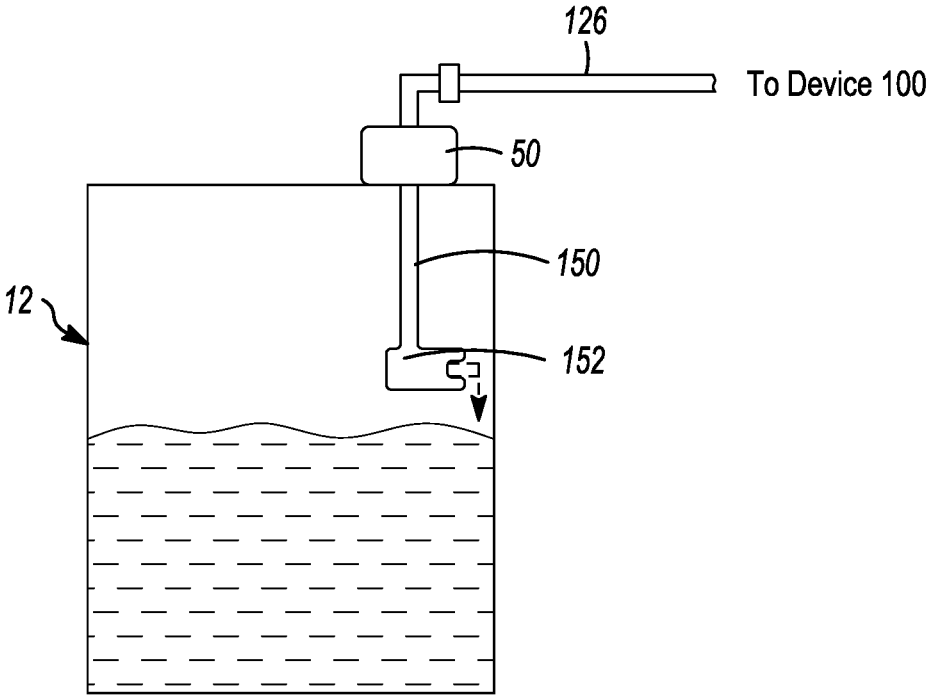
FIG. 6 is a detail view of a representative reservoir with an embodiment of the internal discharge device connected thereto.
Figure 7:
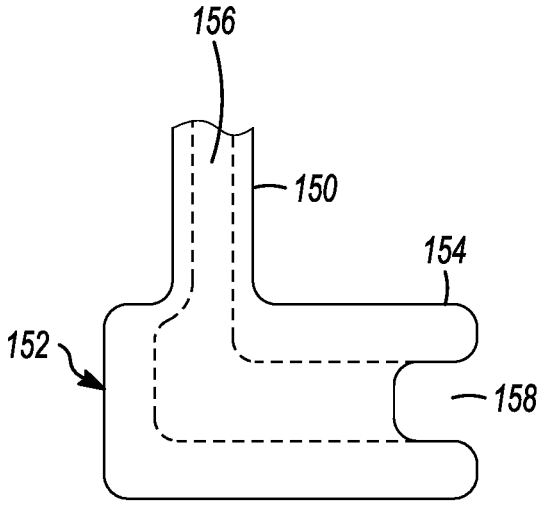
FIG. 7 is a cross-sectional view of an embodiment of the discharge head as disclosed herein.

In certain specific embodiments, the discharge hose 126 is configured to be releasably connected to the on-board reservoir 12 at a location proximate to an upper region 60 of interior volume 48. In the embodiment depicted in FIG. 6, where the on-board reservoir is configured with a breather 58, the connection can be located at the top of the on-board reservoir 12 at a location above the fluid level. In certain embodiments, the discharge hose is releasably connectable to the reservoir 12 at a location on or near the breather 58.

The device 100 also includes a suitable mechanism for releasably engaging the on-board reservoir 12 that can be connected to the terminal end of the discharge hose 122. In certain embodiments, the device 100 includes a wand member 150. The wand member is configured to extend into the interior chamber 48 of the reservoir 12 and to terminate at a location above the level of fluid contained therein. The terminal end of wand member 150 can be configured with a discharge head 152 contiguously connected to the terminal end of the wand member 150. Discharge head 152 has a central body 154 defining an inner chamber in fluid communication with a channel 156 defined in the wand member 150. The discharge head can have any suitable cross-sectional configuration. In certain embodiments, the discharge head will have a generally circular cross-sectional configuration relative to the direction of fluid flow.

The central body 154 includes at least one lateral aperture 158 defined on a body surface that is either perpendicular to or opposed to the direction of fluid flow. Where located in the side wall of discharge head 152, the aperture 158 can define and arc of between 5 and 75 degrees in certain embodiments. With arcs of between 5 and 15, 10 and 20, and 10 and 40 being employed in certain embodiments. Where the discharge head has a single opening, the arc can be between 30 and 75, with arcs between 30 and 50 being employed in certain embodiments. In embodiments having a single aperture, the aperture can be oriented toward the inner surface of the wall of the on-board reservoir 12 at a location above the fluid surface when in the use position.

Where desired or required, the wand member 150 can have a diverter member 142 contiguously connected to the terminal end distal to the discharge hose member 126. In the embodiment depicted the discharge head 152 is configured to direct fluid being reintroduced into the reservoir 12 in a fan-like pattern over the surface of the material. Introduction occurs in a manner that maintains the fluid in a generally stratified manner such that permits fluid to be removed from the bottom of the reservoir in a generally undisturbed manner.

In the process as disclosed herein, the device 100 is connected to the hydraulic tank to container that needs to be reconditioned as via suction hose 124 at location X2. Discharge hose 126 is connected at the top of the reservoir as at breather 50 as discussed previously or at the location designated as X1, immediately downstream of on-board filter 58. The hydraulic system is then turned on and run for at least one interval to circulate fluid though the on-board system. The at least one interval can be a time interval between 10 second and 10 minutes depending on system volume. It is also contemplated that on-board system operation can be conducted in discrete on-off intervals if desired or required. Where desired or required, the device 100 can be operated continuously during these intervals or can be cycled on and off.

In certain embodiments the method can include at least one an actuator operation interval during which hydraulic fluid is introduced and removed from the associated hydraulic actuator such as hydraulic cylinder 24.

When filtering material such as hydraulic fluid stored in a barrel or other container, the device as disclosed herein can be employed in the following manner. The suction hose 126 can be connected to a suitable extension device and inserted into the bottom of the of the hydraulic tank or drum that needs to be filtered. The discharge adapter 150 can be connected to the discharge hose 128 and inserted into the same tank or drum as the suction tube with the discharge adapter positioned at a location above the fluid level in the tank or drum. Note the size and volume of tank being treated.

Connect the shop air supply to the device 100 and open the air valve to start the device filtration pump. In certain embodiments, the device 100 can be configured with pressure gauges 200, 200' associated with respective tanks 112, 112' that can be employed to monitor the effectiveness and operational life of the filtration media in the respective tanks 112, 112'. It is contemplated that at least one tank 112, 112' will include a suitable water absorbing filter that will required changing when the pressure reaches a predetermined value such as 50 psi. It is also contempered that the other tank 112, 112' can be configured with a suitable filtration material such that can entrain material such as particulate and the like.

The device 100 can also include a least one volume measurement device such as a flow meter 145 that can be monitored to determine when the volume of material in the tank or drum has been processed. When this has occurred, the process can be discontinued in drum reconditioning operations.

In operations involving an associated hydraulic system device, the operation and the device 100 can be discontinued, the suction hose 126 can then be moved and repositioned to a location upstream of the on-board filtration unit of the associated hydraulic device 10 and fluid communication can be established. The discharge hose 126 can be connected to the device 10 at a location downstream of the on-board filter but up stream of the reservoir 12 with the device 100 in the powered-down state. The valve assembly 28 of associated with the hydraulic system is the opened and the hydraulic system is cycled in order to flush all cylinders and other components including final drive units. Once the fluid in the hydraulic cylinders has been conditioned, the hydraulic valve 28 can be closed and the device 100 disconnected from fluid contact with the hydraulic device.

In certain embodiments the device for reciprocatingly removing and replenishing fluid in circulating system of a hydraulic system can include one or more of the following: at least two processing tanks; at least one air pressure regulator and connector releasably engageable with a pressurized air source; at least one vacuum generator; and means for removing the fluid from the circulating system under vacuum. In certain embodiments, the device can further include means for reintroducing the removed fluid into the circulating system of a hydraulic system further including a discharge hose configured to be in releasable fluid communication with an upper region of a reservoir present in the hydraulic system, the discharge hose having a fluid flow direction, and wherein the means for removing fluid from the hydraulic system comprises a suction hose, the suction hose in pneumatic communication with the at least one vacuum generator and in fluid communication with at least one of the processing tanks.

The at least two processing tanks can be in fluid communication with one another in series wherein the at least one suction hose is in fluid communication with an upstream pressure tank and the discharge hose is in fluid communication with at least one downstream pressure tank.

The discharge hose can further include a wand member in fluid communication with the discharge hose, the wand member defining a central channel and having a discharge head mounted distal to the discharge hose, the discharge head having a central body defining a central chamber, the central body having at least one aperture defined therein, where the aperture is positioned on the central body at a location perpendicular to or opposed to the discharge hose fluid flow direction.

Also disclosed is a method for reconditioning a volume of fluid in a circulating system in hydraulic system, the hydraulic system having at least one hydraulic actuation device, at a hydraulic fluid circulating system and at least one reservoir, the reservoir having a fluid level that includes the steps of establishing pneumatic and fluid connection with at least one location in hydraulic fluid circulating system and an externally positioned device for reciprocatingly removing and replenishing fluid in the circulating system of a hydraulic system that includes at least two processing tanks; at least one air pressure regulator and connector releasably engageable with a pressurized air source; at least one vacuum generator; means for removing the fluid from the circulating system under vacuum. The method also includes the steps of establishing fluid connection with at least one point in hydraulic system reservoir below the fluid level and the device for reciprocatingly removing and replenishing fluid in circulating system of a hydraulic system, the fluid connection location being different from the pneumatic and fluid connection; after pneumatic and fluid connection is established, drawing a vacuum pressure through said pneumatic connection and removing a volume of hydraulic fluid from a reservoir associated with the hydraulic system in to contact with filtration media contained in the processing tanks and introducing the removed volume of hydraulic into the circulating system through said fluid connection, wherein said fluid connection is at a location in the on-board reservoir at a location above the fluid level in the reservoir.

While the invention has been described in connection with certain embodiments, it is to be understood that the invention is not to be limited to the disclosed embodiments but, on the contrary, is intended to cover various modifications and equivalent arrangements included within the scope of the appended claims, which scope is to be accorded the broadest interpretation so as to encompass all such modifications and equivalent structures as is permitted under the law.

What is claimed is:

1. A device for reciprocatingly removing and replenishing fluid in circulating system of a hydraulic system comprising:
   - at least two processing tanks, each tank having an upper region and an interior chamber;
   - at least one air pressure regulator and connector releasably engageable with a pressurized air source;
   - at least one vacuum generator;
   - means for removing the fluid from the circulating system under vacuum into and through the at least two processing tanks; and
   - a transportable frame, wherein the at least two processing tanks, the at least one air pressure regulator, at least one vacuum generator, and means for removing the fluid from the circulating system under vacuum into and through the at least two processing tanks are operatively mounted on the transportable frame.

2. The device of claim 1 further comprising means for reintroducing the removed fluid into the circulating system of a hydraulic system further comprising a discharge hose configured to be in releasable fluid communication with an upper region of a reservoir present in the hydraulic system, the discharge hose having a fluid flow direction, and wherein the means for removing fluid from the hydraulic system comprises a suction hose, the suction hose in pneumatic communication with the at least one vacuum generator and in fluid communication with at least one of the processing tanks.

3. The device of claim 1 wherein the at least two processing tanks each contain filtration media.

4. The device of claim 1 further comprising means for returning the fluid to the circulating system of a hydraulic system after contact with the at least two processing tanks.

5. The device of claim 4 wherein the means for removing the fluid from the circulating system under vacuum into and through the at least two processing tanks include a suction hose, the suction hose releasably connectable to the circulating system of a hydraulic system, the suction hose connected to an upper portion of one of the at least two processing tanks and wherein the means for returning the fluid to the circulating system of a hydraulic system after contact with the at least two processing tanks is a discharge hose releasably connectable with the circulating system of a hydraulic system, the discharge hose connected to one of the at least two processing tanks, wherein the suction hose and discharge hose are connected to different processing tanks.

6. The device of claim 1 further comprising means for returning the fluid to the circulating system of a hydraulic system after contact with the at least two processing tanks is a discharge hose releasably connectable with the circulating system of a hydraulic system, the discharge hose connected to one of the at least two processing tanks wherein the discharge hose further comprises at least one wand member, the wand member configured to extend interior chamber or a fluid reservoir in fluid contact with the circulating hydraulic system and to terminate at a location above fluid contained therein.

7. The device of claim 6 wherein the at least two processing tanks each have flow directing elements present in the respective interior chamber, wherein the flow directing elements are configured to permit fluid introduced therein to traverse the interior chamber and exit at the upper region of the associated processing tank.

8. The device of claim 6 wherein the wand member includes a discharge head, the discharge head has a central body defining an interior chamber in fluid communication with a channel defined in the wand member and a least one lateral aperture defined on a surface of the central body that is either perpendicular to fluid flow direction or opposed to fluid flow direction.

9. The device of claim 8 wherein the lateral aperture an arc between 5 and 75 degrees.

10. A device for reciprocatingly removing and replenishing fluid in circulating system of a hydraulic system comprising:

at least two processing tanks;

at least one air pressure regulator and connector releasably engageable with a pressurized air source;

at least one vacuum generator; and means for removing the fluid from the circulating system under vacuum into and through the at least two processing tanks, wherein the at least two processing tanks are in fluid communication with one another in series and wherein the at least one suction hose is in fluid communication with an upstream pressure tank and a discharge hose is in fluid communication with at least one downstream pressure tank.

11. The device of claim 10 wherein the discharge hose further comprises a wand member in fluid communication with the discharge hose, the wand member defining a central channel and having a discharge head mounted distal to the discharge hose, the discharge head having a central body defining a central chamber, the central body having at least one aperture defined therein, where the aperture is positioned on the central body at a location perpendicular to or opposed to the discharge hose fluid flow direction.

12. The device of claim 10 wherein the at least two processing tanks each contain filtration media.

13. The device of claim 10 wherein the at least two processing tanks each have flow directing elements present in the respective interior chamber, wherein the flow directing elements are configured to permit fluid introduced therein to traverse the interior chamber and exit at the upper region of the associated processing tank.

14. A method for reconditioning a volume of fluid in a circulating system in hydraulic system, the hydraulic system having at least one hydraulic actuation device, a hydraulic fluid circulating system, and at least one reservoir, the reservoir having a fluid level, the method comprising the steps of:

establishing pneumatic and fluid connection with at least one location in hydraulic fluid circulating system and an externally positioned device for reciprocatingly removing and replenishing fluid in the circulating system of a hydraulic system that includes:

at least two processing tanks;

at least one air pressure regulator and connector releasably engageable with a pressurized air source;

at least one vacuum generator;

means for removing the fluid from the circulating system under vacuum;

establishing fluid connection with at least one point in hydraulic system reservoir below the fluid level and the device for reciprocatingly removing and replenishing fluid in circulating system of a hydraulic system, the fluid connection location being different from the pneumatic and fluid connection;

after pneumatic and fluid connection is established, drawing a vacuum pressure through said pneumatic connection and removing a volume of hydraulic fluid from a reservoir associated with the hydraulic system in to contact with filtration media contained in the processing tanks and introducing the volume of hydraulic fluid removed from the reservoir into the circulating system through said fluid connection, wherein said fluid connection is at a location in the on-board reservoir at a location above the fluid level in the reservoir.

15. The method of claim 14 further comprising the steps of:

discontinuing vacuum pressure operations after hydraulic fluid in the on-board reservoir has been processed;

establishing fluid communication between the at least one hydraulic actuator and the circulating system on the hydraulic device;

repositioning the suction hose of the external processing device to a location in fluid contact with circulating system downstream of the hydraulic actuator device;

repositioning the discharge hose to a location in the hydraulic system reservoir above the fluid level; and operating the hydraulic system for an interval sufficient to circulate fluid contained in the at least one actuator through the externally positioned device and into the hydraulic system reservoir.

16. The method of claim 14 wherein the device for reciprocatingly removing and replenishing fluid in the circulating system of a hydraulic system further comprises a discharge hose, the discharge hose further comprises a wand member in fluid communication with the discharge hose, the wand member defining a central channel and having a discharge head mounted distal to the discharge hose, the discharge head having a central body defining a central chamber, the central body having at least one aperture defined therein, where the aperture is positioned on the central body at a location perpendicular to or opposed to the discharge hose fluid flow direction.

17. The method of claim 14 wherein the at least two processing tanks are in fluid communication with one another in series and wherein at least one suction hose is in fluid communication with an upstream pressure tank and a discharge hose is in fluid communication with at least one downstream pressure tank.

* * * * *